United States Patent [19]

Sasaki et al.

[11] 4,324,051

[45] Apr. 13, 1982

[54] PROCESS AND APPARATUS FOR RECOVERING HEAT FROM FINELY TO COARSELY DIVIDED MATERIAL HAVING HIGH TEMPERATURE

[75] Inventors: Katsuhiko Sasaki; Masaru Sakaba, both of Nara; Kingo Hayashi, Takatsuki, all of Japan

[73] Assignee: Hitachi Shipbuilding & Engineering Co., Ltd., Osaka, Japan

[21] Appl. No.: 163,844

[22] Filed: Jun. 27, 1980

[30] Foreign Application Priority Data

Jul. 7, 1979 [JP] Japan ..... 54-86147

[51] Int. Cl.[3] ..... F26B 5/00

[52] U.S. Cl. ..... 34/20; 34/35; 34/65; 34/86; 165/112; 165/104.34; 432/13; 432/18

[58] Field of Search ..... 34/20, 64, 65, 35, 86; 165/104 R, 104 S, 112, 119; 432/13, 18

[56] References Cited

U.S. PATENT DOCUMENTS

| | | | |
|---|---|---|---|
| 3,705,620 | 12/1972 | Kayatz | 34/65 |
| 4,037,330 | 7/1977 | Kemmetmuller | 34/20 |
| 4,123,850 | 11/1978 | Niems | 34/20 |

*Primary Examiner*—Larry I. Schwartz

*Attorney, Agent, or Firm*—Whittemore, Hulbert & Belknap

[57] ABSTRACT

A process and an apparatus for recovering heat from a finely to coarsely divided hot material, such as carbide crushed on solidification, which contains particles and lumps of varying sizes. The hot material is separated by a classifier into a portion of lumps and a portion of particles, and the lump portion is cooled in a cooling bunker with a stream of cooling gas while the particulate portion is cooled in another cooling unit with a stream of cooling gas. The hot cooling gas resulting from the cooling is fed to a heat exchanger in which the gas is subjected to heat exchange with a working fluid for a turbine coupled to a power generator or the like. The heat exchanger is connected to the cooling bunker and unit by a closed circulating channel.

10 Claims, 4 Drawing Figures

PROCESS AND APPARATUS FOR RECOVERING HEAT FROM FINELY TO COARSELY DIVIDED MATERIAL HAVING HIGH TEMPERATURE

The present invention relates to a process and an apparatus for efficiently recovering heat from particulate to granular hot materials, especially from finely to coarsely divided materials having a high temperature and containing particles and lumps of varying sizes. Stated more specifically the process and apparatus of this invention are useful for recovering heat, for example, from carbide discharged from an electric furnace by crushing the carbide on solidification and cooling the crushed carbide with a cooling gas.

For cooling the carbide produced in an electric furnace, the carbide in a molten state is usually placed into a container and cooled in a cooling chamber over a period of about 16 hours, allowing the carbide to release heat to the atmosphere. Since the carbide as discharged from the furnace in a molten state has a high temperature of about 2000° C. and a large amount of heat, it is desired to recover the heat released from the carbide when it is cooled to a solid having room temperature. Accordingly it has been proposed to solidify the molten carbide, crush the carbide in a hot state and apply a cooling gas to the crushed carbide for the recovery of heat.

To practice this process, it is known to charge the crushed hot carbide in a cooling bunker or pass the carbide through a cooling device including a rocking grate to apply a cooling gas to the carbide for heat exchange and obtain a hot gas for the recovery of heat.

However since the crushed carbide contains fine particles as well as lumps, the layer of hot charge in the bunker has reduced interstices, subjecting the cooling gas to a marked pressure loss and resulting in a lower cooling velocity. On the other hand, an attempt to assure an increased cooling velocity requires a greater power consumption and a larger apparatus.

Although the use of the rocking grate type cooling device involves a smaller pressure loss even when the crushed material contains some amount of fine particles, there is the problem that when the supply of crushed material is interrupted even if temporarily, the grate becomes locally uncovered with the material, immediately failing to afford a hot gas. The device has another problem that the cooling gas having an elevated temperature afforded by the heat exchange is not as hot as is desired. While heat should be recovered preferably at high temperatures in view of the efficiency of the heat exchanger and the utilization of the recovered heat, the device is unable to fully fulfill this requirement.

The main object of this invention is to provide a process for recovering heat from a finely to coarsely divided hot material with reduced pressure losses, at a high cooling velocity and at a relatively high temperature even when the material contains particles and lumps of varying sizes.

To attain this object, the invention provides a process comprising the steps of separating a finely to coarsely divided material having a high temperature into a portion of lumps and a portion of particles, applying a cooling gas to each of the separated portions individually and recovering heat from the cooling gas resulting from the cooling and having an elevated temperature. When the portion of lumps and the portion of particles are cooled as separated from each other, each of the portions can be cooled efficiently by a method or device suited to the properties thereof.

According to a preferred embodiment of the invention, the stream of cooling gas resulting from the cooling of the portion of particles and having a relatively low elevated temperature is joined with the stream of cooling gas resulting from the cooling of the portion of lumps and having a relatively high elevated temperature, thereby assuring an improved heat exchange efficiency and utilization of heat at a high temperature.

According to another preferred embodiment, the stream of cooling gas resulting from the cooling of the portion of particles, when having an elevated but very low temperature, is introduced into part of the path for the stream of cooling gas for the portion of lumps where the latter stream has a temperature approximate to that of the former stream, thereby assuring recovery of heat at a temperature suited to heat exchange and to the utilization of heat.

For the use of the cooling gas in circulation, the gas is passed through a closed circulating channel, which is provided with a bypass having a flow regulator and bypassing a cooling unit so that heat can be recovered at a constant temperature.

Preferably, a cooling bunker is used for cooling the portion of lumps, and a cooling unit of the rocking grate type for cooling the portion of particles. A unit with a fluidized bed is usable also for cooling the latter.

Various other features and advantages of the invention will become apparent from the following description of the preferred embodiments with reference to the accompanying drawings, in which.

Figure 1:
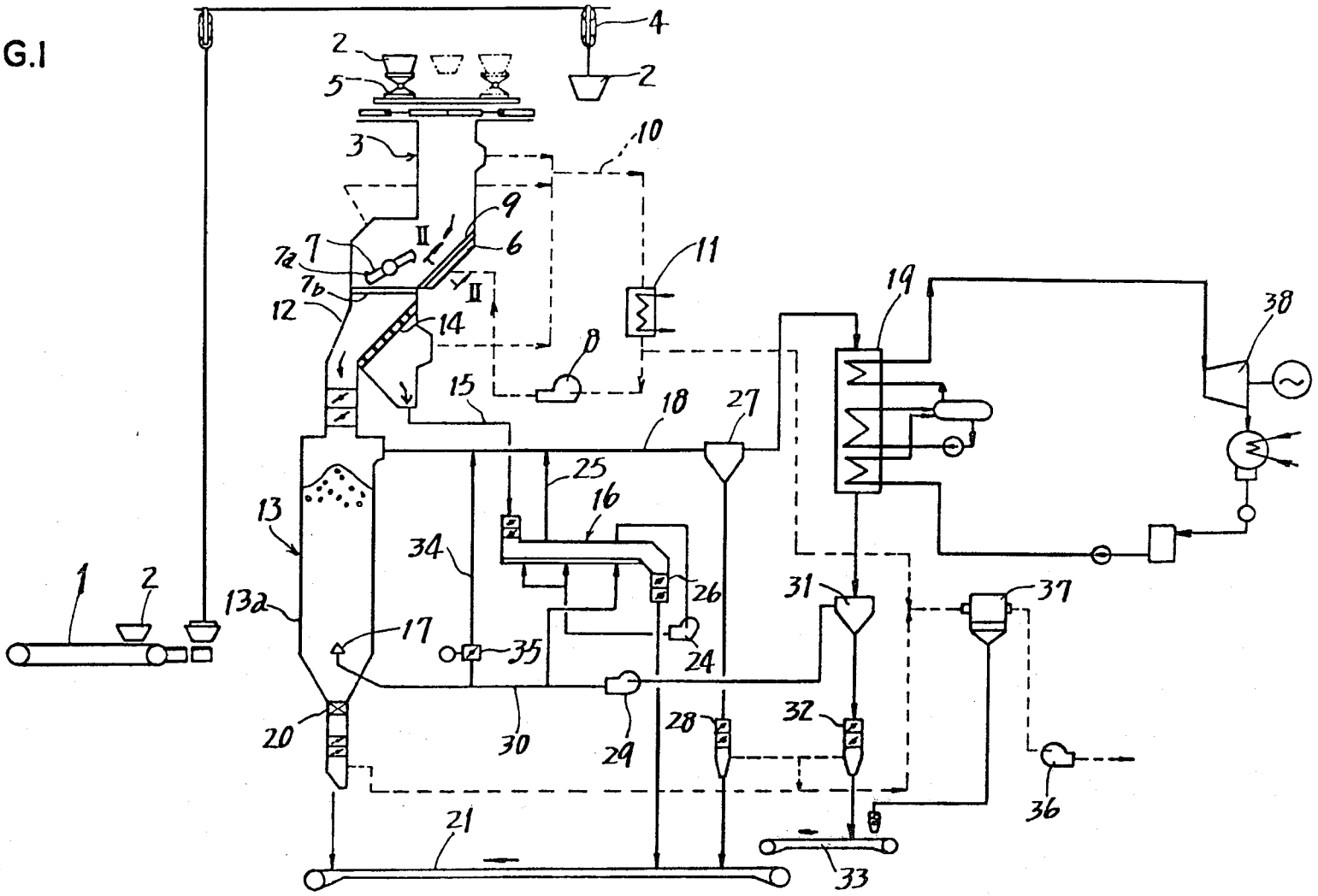
FIG. 1 is a system diagram showing an apparatus embodying the invention for recovering the heat released from carbide when it is cooled.
Figure 2:
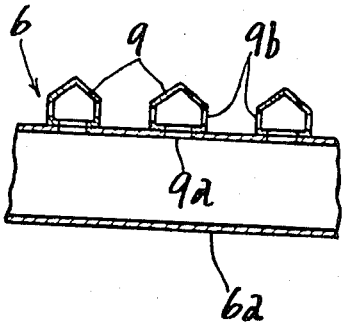
FIG. 2 is a view taken along the line II—II in FIG. 1.

With reference to FIG. 1, indicated at 1 is a conveyor by which containers 2 containing the molten carbide produced in an electric furnace are automatically transported to a location close to a heat recovering apparatus. During transport, the carbide in the container 2 solidifies. The container 2 sent forward on the conveyor 1 is carried by a crane 4 to the position of an automatic feeder 5, by which the solid carbide in the container 2 is charged into a crushing unit 3. The crushing unit 3 includes primary crushing means comprising a crushing deck 6 by which the charge is crushed by being allowed to fall thereon, and secondary crushing means comprising a rotary crusher 7 by which the charge crushed by the deck 6 is further divided to specified sizes. As seen in FIG. 2, the crushing deck 6 comprises a box-shaped deck main body **6*a* and a multiplicity of projections 9 attached to the upper wall of the main body. Each of the projections 9 is in the form of a polygonal pipe having a ridge-like top wall and side walls formed with outlets 9*b* for discharging a cooling gas. The interior of the main body 6*a* is held in communication with the interior of the pipes through apertures 9*a*. The cooling gas is sent into the main body 6*a* by a fan 8. While it is likely that when blocks of carbide fall onto and are crushed by the deck 6, internal molten portions of carbide will scatter about, the scattered portions of carbide can be rapidly cooled with the gas forced out from the outlets 9b. The crusher 7 comprises a number of blades 7a fixed to a rotary shaft and a number of blades 7b in the form of parallel plates. The cooling gas heated to a high temperature in the closed crusher unit 3 is sent through a duct 10 to a heat exchanger 11 for the recovery of heat. A major portion of the cooling gas is thereafter fed to the crushing unit 3 by the fan 8 and used in circulation, while a portion of the gas is released to the atmosphere through a dust collecting filter 37 by a fan 36. The interior of the unit 3** is maintained at a pressure slightly lower than the atmospheric pressure to prevent escape of the cooling gas from the feed inlet when carbide is charged in.

A portion of the carbide subjected to secondary crushing by the crusher 7 of the unit 3 which portion is in the form of lumps is passed through a chute 12 into a cooling bunker 13 for cooling the portion of lumps.

The chute 12 is provided at an intermediate portion thereof with a screen 14 by which particles are separated from the carbide passing through the chute 12. The particulate portion is fed to a cooling unit 16 through a channel 15.

The cooling bunker 13 comprises a main body 13a in the form of a hollow cylindrical container having a vertical axis, an inlet for the lump portion at its upper end, an outlet therefor at its lower end and a gas distributor 17 at a lower part thereof for injecting a cooling gas into the main body. The cooling gas forced into the bunker 13 undergoes heat exchange with the hot carbide and is thereby heated to an elevated temperature. The gas thus heated (hereinafter referred to as "hot gas") flows out from an outlet at an upper portion of the bunker 13 and is led through a duct 18 into a waste heat recovering boiler 19 serving as a heat exchanger. Since the carbide in the cooling bunker 13 is in the form of lumps only and is free from particles, the cooling gas released from the distributor 17 and passing through the layer of carbide undergoes only a small reduction in pressure and achieves a high cooling efficiency. Accordingly the cooling bunker can be of small size. The carbide cooled in the bunker 13 is discharged therefrom through a shut-off valve 20 at the lower end outlet in the same amount as the charge through the chute 12 and is delivered onto a discharge conveyor 21.

Figure 4:
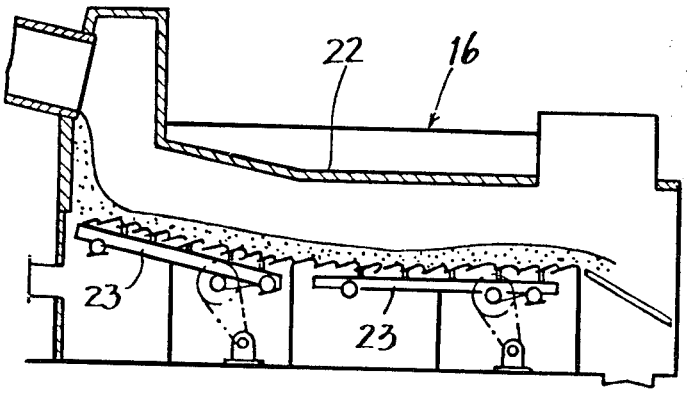
FIG. 4 is a diagram in vertical section showing a cooling unit of the rocking grate type for cooling particles.

Useful as the cooling unit 16 for the particle portion is a cooling unit of the rocking grate type which per se is known as shown in FIG. 4 and disclosed in Published Examined Japanese Patent Application No. 49-15614. FIG. 4 shows the main body 22 of the unit and grates 23 which are driven for a rocking motion. While being sent forward over the grates 23, the particulate material is brought into contact with and cooled by the cooling gas supplied thereto by a fan 24 in circulation. The gas subjected to heat exchange with the particulate material and thereby heated to an elevated temperature (hot gas) is led through a duct 25 into the duct 18 from the bunker 13 and then conducted to the boiler 19. Although the hot gas obtained from the cooling unit 16 has a relatively low temperature, heat can be recovered therefrom at a relatively high and uniform temperature when the gas is admixed with the hot gas from the bunker 13 as above. The particulate carbide cooled in the unit 16 is discharged therefrom and placed onto the conveyor 21 via discharge means 26 equipped with a double damper. The duct 18 extending to the boiler 19 is provided at an intermediate portion with a dust separator 27 by which the dust of carbide entrained in the hot gas is removed therefrom. The dust accumulating on the lower end of the separator 27 falls onto the product discharge conveyor 21 via dust discharge means 28 having a double damper. A unit including a fluidized bed or like other known unit is usable also as the cooling unit 16 for the particulate material.

Heat is recovered from the hot gas led into the boiler 19, and the resulting gas of low temperature is pressurized by a circulating fan 29 and then conducted to the bunker 13 and to the cooling unit 16 via a duct 30. To prevent abrasion of the blades of the fan 29, the heat recovering boiler 19 has at its lower portion a multi-cyclone 31 for removing dust from the gas. The dust removed by the multi-cyclone 31 is delivered to a product discharge conveyor 33 by way of a dust discharge means 32 which is equipped with a double damper to prevent escape of the circulating gas. The cooling gas supply duct 30 extending to the bunker 13 is held in communication with the hot gas discharge duct 18 through a bypass duct 34 which is provided with a regulating valve 35. In accordance with the temperature of the gas through the duct 18, the degree of opening of the valve 35 is automatically adjusted to supply the gas of low temperature through the duct 30 to the duct 18 via the bypass 34 and thereby adjust the gas flowing into the boiler 19 to a constant temperature.

The carbide feed inlets and discharge outlets of the bunker 13 and cooling unit 16, as well as the dust outlets at the lower ends of the dust discharge means 28, 32 are connected by ducts to the suction fan 36, such that the dust released on feeding or discharge is collected in the filter or cyclone 37 by the action of the fan 36 to release clean air to the atmosphere.

The steam produced in the heat recovering boiler 19 by heating with the hot gas is fed to a power generating plant in which a steam turbine 38 is driven with the steam.

When the finely to coarsely divided material, like carbide, is chemically reactive with the oxygen in air, an inert gas must be used as the cooling gas. Generally usable as inert gases are $CO_2$, $N_2$, argon and like gases. When carbide is treated with use of air which is circulated through a closed channel as a cooling gas as is the case with the illustrated embodiment, the air will react with carbide in an initial stage, giving an inert gas. Stated more specifically carbide reacts with the oxygen in air according to Equation (1) to form $CO_2$.

$$CaC_2+5/2O_2 \rightarrow CaO+2CO_2 \quad (1)$$

At a high temperature, carbide also reacts with part of $N_2$ in air, giving a small amount of $CaCN_2$, which further reacts with the oxygen in air according to Equation (2) to yield $CO_2$ and $N_2$.

$$CaCN_2+3/2O_2 \rightarrow CaO+CO_2+N_2 \quad (2)$$

Thus when the apparatus is initiated into operation, part of carbide reacts with oxygen and forms CaO, but with the consumption of oxygen in the circulating cooling air through the above reactions, the air changes to an inert gas. Even when some air thereafter flows into the apparatus, the above reactions take place to eliminate objections.

Figure 3:
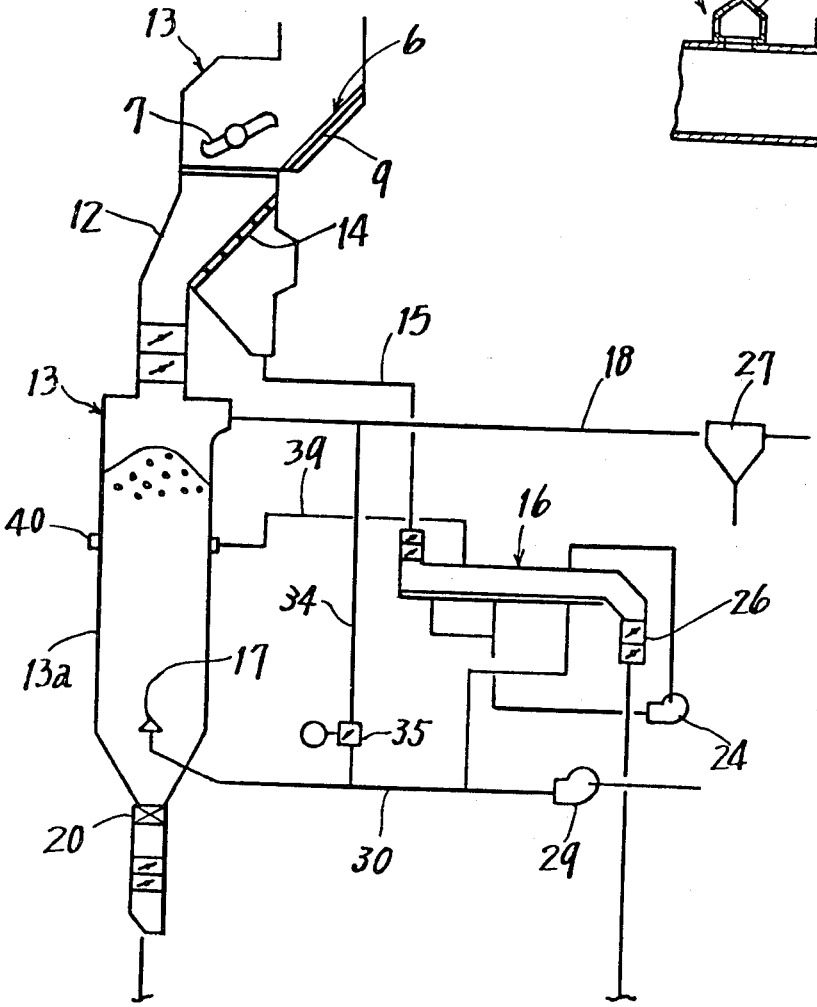
FIG. 3 is a fragmentary diagram similar to FIG. 1 and showing a modified embodiment of the invention.

FIG. 3 shows another embodiment which is useful when the hot gas obtained from the cooling unit 16 for the particulate material has a very low temperature. The hot gas obtained from the unit 16 is led through a duct 39 and introduced into an intermediate portion of the stream of cooling gas through the carbide layer within the bunker 13, namely into a portion of the carbide layer having the same temperature as the hot gas. The hot gas is so introduced through an air box 40 around the bunker main body 13*a* uniformly over the entire circumference of the body 13*a*. The hot gas thus fed and the gas released from the distributor 17 and heated to a hot state are subjected to heat exchange with the carbide and thereby heated, and the combined gas stream is led through the duct 18 to the heat recovering boiler 19. Since the hot gas obtained from the cooling unit 16 is heated in the bunker 13 before heat recovery, heat can be recovered efficiently at a high temperature even when the hot gas obtained in the unit 16 has a low temperature. Because the heat exchange is effected at a high temperature, a waste heat recovering boiler or some other heat exchanger of small heat transfer area and therefore of compact construction is usable, while the heat recovered at a high temperature is usable for wide applications.

Although the above embodiments have been described for the recovery of heat from carbide, the invention is applicable for recovering heat from various finely to coarsely divided materials having a high temperature.

What is claimed is:

1. A process for recovering heat from a finely to coarsely divided material having a high temperature comprising the steps of separating the material into a portion of lumps and a portion of particles, forcibly applying a stream of cooling gas to substantially the entirety of one separated portion of material and forcibly applying a separate stream of cooling gas to substantially the entirety of the other separated portion of material in a manner such that neither stream of cooling gas has been preheated by the other when applied to the respective portion of material, and recovering heat from both streams of cooling gas.

2. A process as defined in claim 1 wherein the stream of cooling gas resulting from the cooling of the portion of particles and having an elevated temperature is joined with the stream of cooling gas resulting from the cooling of the portion of lumps and having an elevated temperature, and the combined stream is subjected to heat exchange with a working fluid for the recovery of heat.

3. A process as defined in claim 1 wherein the stream of cooling gas resulting from the cooling of the portion of particles and having an elevated temperature is joined with the stream of cooling gas which is cooling the portion of lumps, and the combined stream resulting from the cooling of the lump portion and having an elevated temperature is subjected to heat exchange with a working fluid for the recovery of heat.

4. An apparatus for recovering heat from a finely to coarsely divided material having a high temperature comprising a classifier for separating the material into a portion of lumps and a portion of particles, a cooling unit with means for forcibly applying a stream of cooling gas to substantially the entirety of the separated portion of lumps for cooling, a cooling unit with means for forcibly applying a stream of cooling gas to substantially the entirety of the separated portion of particles for cooling said cooling units being independent of one another and neither stream of cooling gas having been preheated by the other when applied to the respective portion of material, and a heat exchanger for subjecting a working fluid for a power generator to heat exchange with the cooling gas resulting from the cooling at the cooling units and having an elevated temperature.

5. An apparatus as defined in claim 4 wherein a closed channel for circulating the cooling gas is provided between the heat exchanger and the cooling units.

6. An apparatus as defined in claim 5 wherein the circulating channel is provided with a bypass channel extending between a gas inlet portion of the lump portion cooling unit and a gas outlet portion thereof for bypassing the lump portion cooling unit, and the bypass channel has a regulating valve.

7. An apparatus as defined in claim 5 wherein the closed circulating channel is provided between the heat exchanger and the lump portion cooling unit, and the particle portion cooling unit is connected to the closed circulating channel in parallel to the lump portion cooling unit.

8. An apparatus as defined in claim 5 wherein the closed circulating channel is provided between the heat exchanger and the lump portion cooling unit, and the particle portion cooling unit has a cooling gas inlet communicating with a cooling gas inlet of the lump portion cooling unit and a cooling gas outlet communicating with an intermediate portion of the cooling gas channel within the lump portion cooling unit.

9. An apparatus as defined in claim 4 wherein the lump portion cooling unit comprises a cooling bunker including a hollow cylindrical container having an inlet for the lump portion at its upper end, an outlet therefor at its lower end and a vertical axis, and the cooling gas is introduced into the container approximately from the lower end and discharged therefrom approximately at the upper end.

10. An apparatus as defined in claim 4 wherein the particle portion cooling unit comprises a cooling unit of the rocking grate type.

* * * * *